United States Patent [19]

Schultz

[11] 4,396,209

[45] Aug. 2, 1983

[54] LOOSE LEAF BINDER

[76] Inventor: Herold E. Schultz, 3 Waljo Trail, Milford, Ohio 45150

[21] Appl. No.: 223,127

[22] Filed: Jan. 7, 1981

[51] Int. Cl.[3] ..... B42D 3/18

[52] U.S. Cl. ..... 281/45; 150/34; 206/450

[58] Field of Search ..... 281/45–50, 281/1, 29, 36, 38; 402/500, 501, 57, 60, 61, 8, 9; 206/523, 521, 556, 592, 306, 450, 451, 449, 472, 516, 517, 480, 522, 524, 591, 593, 433, 317, 471, 509; 150/52 H, 52 C; 190/24, 16

[56] References Cited

U.S. PATENT DOCUMENTS

| | | | |
|---|---|---|---|
| 1,336,438 | 4/1920 | Kraetsch | 281/45 |
| 1,397,645 | 11/1921 | McNeill et al. | 281/45 |
| 2,073,337 | 3/1937 | Dewar et al. | 281/36 X |
| 2,526,909 | 10/1950 | Slonneger | 281/45 X |
| 2,645,334 | 7/1953 | Aldridge | 206/306 |
| 2,650,700 | 9/1953 | Wolf | 150/34 |
| 3,141,213 | 7/1964 | Rinaldi | 402/501 |
| 3,192,978 | 7/1965 | Horvath | 217/35 X |
| 3,612,233 | 10/1971 | Nagpal et al. | 206/403 X |
| 3,647,076 | 3/1972 | Heimann | 206/449 X |
| 4,090,374 | 5/1978 | Faust et al. | 206/451 X |
| 4,241,829 | 12/1980 | Hardy | 206/591 X |

*Primary Examiner*—Paul A. Bell
*Assistant Examiner*—John S. Brown
*Attorney, Agent, or Firm*—King and Liles

[57] ABSTRACT

A non-destructive loose leaf binder for securing and protecting loose leaves of paper is provided with a pressure member affixed to one of a pair of flexibly connected rigid panel members proximal to the flexible connection between the panel members. When the panel members are moved to an overlaying relationship, the pressure member applies a compressive force to the adjoining panel member to selectively secure paper sheets interposed between the panel members.

8 Claims, 6 Drawing Figures

LOOSE LEAF BINDER

BACKGROUND

The present invention relates generally to loose leaf binders for securing loose leaves of paper and more particularly concerns a non-destructive binder which holds sheets of paper without damaging the paper sheets. The invention will be specifically disclosed in connection with a hard cover loose leaf binder for holding, protecting or carrying of papers, drawings, paintings, blueprints, etc.

Although loose leaf binders for protecting, organizing and securing papers are in wide spread use today, the overwhelming majority of these binders require holes in the papers to secure the papers in the binders. These hole requiring binders have obvious disadvantages when the papers to be carried or secured are of a nature which cannot be damaged or mutilated. Thus, in such circumstances, it is highly desirable to utilize a non-destructive binder.

The non-destructive binders which have been used in the past have generally been bulky or inconvenient for many purposes. It is therefore an object of the present invention to provide a binder which is simple in construction and which will hold papers non-destructively without the requirement of holes in the contained papers.

SUMMARY OF THE INVENTION

In accordance with the invention, a loose leaf binder for selectively securing paper sheets is provided which includes a pair of planar panel members with adjoining straight line peripheral surfaces. The planar panel members are secured along their adjoining straight line peripheral surfaces by a flexible connecting means. The flexible connecting means permits movement of one of the panel members relative to the other from a first position in which said one panel member is generally in co-planar relationship with the other panel member to a second position in which said one panel member has been rotated about an axis line between the adjoining peripheral surfaces to a generally overlying relationship with said other panel member. The flexible connecting means is held in tension between the adjoining straight line peripheral surfaces when the one panel is in the second position. A resilient pressure member is securely affixed to at least one of said panel members proximal to its adjoining straight line peripheral surface. The pressure member is resiliently deformable when said one panel member is moved to its second position to selectively apply pressure against the other panel member along a line proximal to the other panel's straight line peripheral surface.

BRIEF DESCRIPTION OF THE DRAWINGS

Other objects and advantages of the invention will become apparent upon the following detailed description and upon reference to the drawings, in which.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

Figure 1:
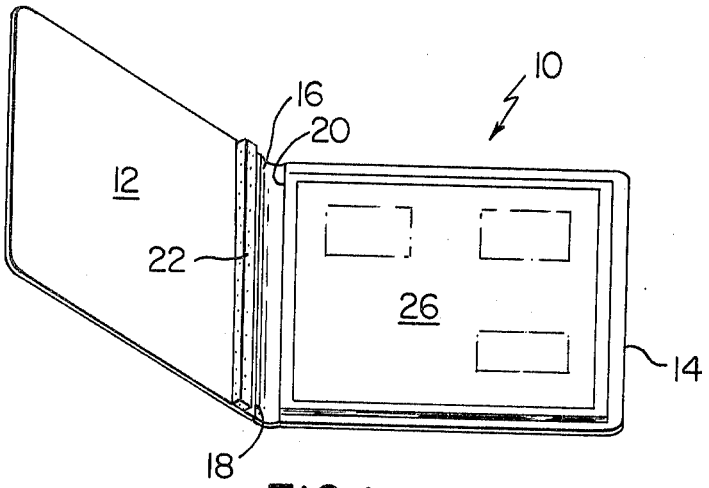
FIG. 1 is a perspective view of the interior side of a loose leaf binder made in accordance with the present invention.

Referring now to the drawings, FIG. 1 shows a loose leaf binder 10 made in accordance with the present invention. The binder 10 includes a pair of rigid panel members 12 and 14 which are secured to each other by a flexible connecting means 16 in a conventional fashion. The flexible connecting means 16 is attached to the adjoining straight line peripheral surfaces 18 and 20 of panel members 12 and 14 respectively.

The flexible connecting means 16 permits relative movement between the panel members 12 and 14. Relative to the panel member 14, the panel member 12 is movable from a first position in which it is disposed in a substantially co-planar relationship with the panel member 14 to a second position in which it is disposed in substantially overlaying relationship with the panel member 14. The illustration of FIG. 1 depicts the panel member 12 between these two positions whereas the illustration of FIG. 3 shows the second position in which the two panels 12 and 14 are in overlaying relationship.

Figure 3:
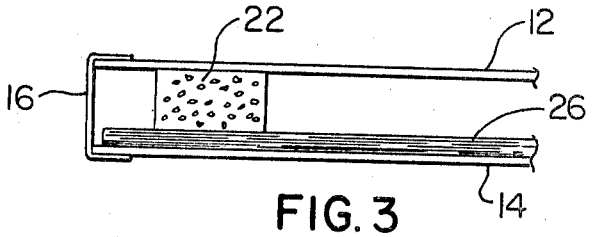
FIG. 3 is an end view of the loose leaf binder of FIG. 1 depicting the pressure member in contacting relationship with papers interposed between the pressure member and a rigid panel of the binder.

As may be realized from FIGS. 1 and 3 jointly, the movement of panel member 12 relative to the panel member 14 is achieved by rotating the panel member 12 about an axis which lies between the adjoining straight line surfaces 18 and 20 of panel members 12 and 14 respectively.

Figure 2:
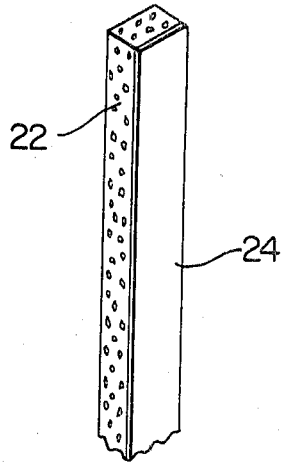
FIG. 2 is a perspective view of the resilient pressure member which is secured to the loose leaf binder of FIG. 1.

The illustration of FIG. 1 also shows a resilient pressure member 22 secured to the panel member 12. The pressure member 22 extends along a line which is proximal and substantially parallel to the straight line peripheral surface 18. The specific type of pressure member 22 used in FIG. 1 is shown in greater detail in FIG. 2 where it is seen that this pressure member 22 is a sponge-like strip. In the most preferred form of the invention, a piece of sponge-like material of the type normally used for weather stripping, such as that illustrated in FIG. 2, is used to form this pressure member 22. Weather stripping material has been found to be advantageous because of its ready availability and its pre-cut lateral dimensions. Also, conventional weather stripping has an adhesive coated backside which may be used in affixing the pressure member 22 to the panel member 12. This adhesive coating on the weather stripping 22 is normally covered by a protective mat 24 which is easily removed from the strip 22 by peeling. The exposed adhesive is then applied to the panel member 12 with light pressure to affix the strip or pressure member 22 to the panel 12.

As mentioned above, FIG. 3 depicts the rigid panel members 12 and 14 in overlaying relationship. When so positioned, the flexible connection means 16 is in tension between the adjoining straight line surfaces. The pressure member 22 is compressingly interposed between the pair of panel members 12 and 14 and applies pressure against rigid panel member 14. It is important that the flexible connecting means be in tension in this position to avoid having the rigid panel member 12 pivot about the pressure member 22. When a sheet of paper, such as sheet 26 illustrated in FIG. 3, is positioned between the pressure member 22 and the panel member 14, that pressure is applied through the sheets 26 to compressingly engage the sheet 26.

Figure 5:
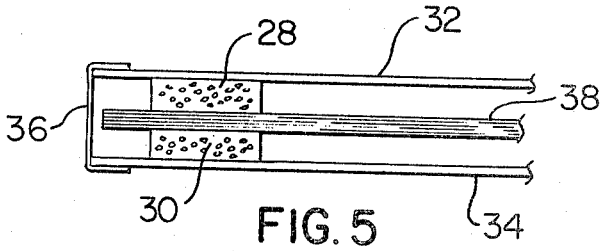
FIG. 5 is an end view of a still further embodiment of the present invention.

A variation of the embodiment of FIG. 1 is illustrated in FIG. 5. Unlike FIG. 1 which uses but a single pressure member 22, the embodiment of FIG. 5 employs a pair of pressure members 28 and 30. These pressure members are, like the pressure member 22 in FIG. 1, formed of a sponge-like adhesive backed material of the type which is normally used for weather stripping. The adhesive on the backside of these pressure members 28 and 30 are used to secure the pressure memnber to rigid panel members 32 and 34 respectively. The rigid panel members 32 and 34 are connected by a flexible connecting means 36 along substantially straight line peripheral surfaces in a manner which is identical with the embodiment of FIG. 1, the flexible connecting means 36 permitting relative movement between the panel members 32 and 34 so that the panel member 32 may be moved from a substantially co-planar relationship with respect to the panel member 34 to a substantially overlaying relationship. Like the embodiment of FIG. 1, this relative movement between the rigid panel members 32 and 34 is about an axis which lies between their adjoining straight line peripheral surfaces. Unlike the embodiment of FIG. 1, the embodiment of FIG. 5 secures sheets of paper, such as sheets 38 in FIG. 5, by compressingly engaging the sheets 38 between the pressure members 28 and 30 when the panels members 32 and 34 are in overlaying relationship. FIG. 5 illustrates paper sheets 38 being secured in this manner.

Figure 6:
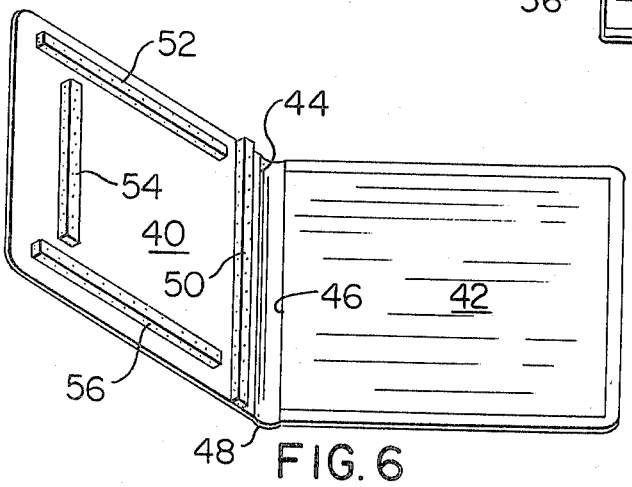
FIG. 6 is a perspective view of yet another embodiment of the present invention with a plurality of pressure members.

Another variation is shown in FIG. 6 which resembles FIG. 1 with additional pressure members. In FIG. 6, a pair of rigid panel members 40 and 42 are connected along adjoining straight line peripheral surfaces 44 and 46 by a flexible connecting means 48 as previously described in connection with FIGS. 1 and 5. In addition to a pressure member 50, which is fully analogous to pressure member 22 in FIG. 1, the FIG. 6 embodiment has three additional pressure members 52, 54 and 56. Pressure members 52 and 56 are positioned along further peripheral surfaces of the panel 40 while pressure member 54 is more centrally disposed upon panel 40. The pressure members 52, 54 and 56 function in a manner fully analogous to the previously described pressure member 22 to compressingly engage paper sheets between themselves and the opposed rigid panel member 42.

Figure 4:
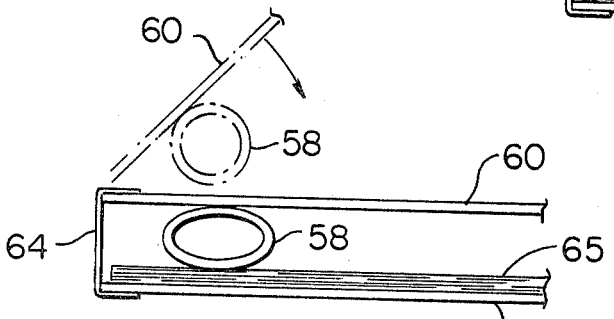
FIG. 4 is an end view of an alternate embodiment of a loose leaf binder made in accordance with the present invention.

A still further embodiment of the invention is illustrated in FIG. 4 which utilizes a resiliently flexible tube-like pressure member 58 in lieu of the sponge-like pressure members previously described.

The tube like pressure member 58 is secured to a first panel member 60 by adhesive or the like along a substantially straight line peripheral surface of panel member 60. A second panel member 62 is joined to the first panel member 60 along an adjoining straight line peripheral surface by a flexible connecting member 64 in a conventional manner. When the panel member 60 is moved to an overlaying relationship with panel member 62 (which movement is illustrated by the phantom line depiction in FIG. 4), the pressure member 58 applies a compressive force against the second panel member 62 through an interposed sheet of paper 65.

Thus it is apparent that there has been provided, in accordance with the invention, a device that fully satisfies the objects, aims, and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A loose leaf binder for selectively securing paper sheets, comprising:

(a) a pair of rigid planar panel members with adjoining straight line peripheral surfaces, said panel members securing at least one interposed paper sheet;

(b) a flexible web for connecting said panel members along their adjoining straight line peripheral surfaces, said flexible web permitting movement of one of said panel members relative to the other from a first position in which said one panel member is in generally co-planar relationship with said other panel member to a second position in which said one panel member has been rotated about an axis lying between the adjoining straight line peripheral surfaces to a generally overlaying relationship with said other panel member, said flexible web being held in tension between the adjoining straight line peripheral surface when one panel member is in the second position; and (c) a resilient elastomeric pressure member securely affixed to at least one of said pair of panel members proximal to said at least one panel member's adjoining straight line peripheral surface, said pressure member being resiliently deformable when said one panel member is moved to its second position to selectively apply pressure against the other panel through the interposed paper sheet along a line proximal to the other panel's straight line peripheral surface.

2. A loose leaf binder as recited in claim 1 wherein said pressure member extends along substantially the entire adjoining straight line peripheral surface of said at least one panel member.

3. A loose leaf binder as recited in claim 1 wherein said pressure member is formed of a sponge-like resilient material.

4. A loose leaf binder as recited in claim 3 wherein said sponge-like resilient is secured to said at least one panel member by an adhesive.

5. A loose leaf binder as recited in claim 1 wherein said panel members are approximately the same size and wherein the joined panel members are substantially symetrical about the web.

6. A loose leaf binder as recited in claim 5 further including pressure members extending along additional peripheral surfaces of said at least one panel member.

7. A loose leaf binder as recited in claim 3 further including an additional sponge-like pressure member proximal to the adjoining straight line peripheral surface on said other panel member, said further pressure member being spaced from said web by a distance substantially equal to the distance by which said pressure member is spaced from said web on said at least one panel member.

8. A loose leaf binder as recited in claim 1 further including an additional pressure member proximal to the adjoining straight line peripheral surface on said other panel member, said further pressure member being spaced from said web by a distance substantially equal to the distance by which said pressure member is spaced from said web on said at least one panel member.

* * * * *